US009791215B2

(12) United States Patent
De Francisco Moreno et al.

(10) Patent No.: US 9,791,215 B2
(45) Date of Patent: Oct. 17, 2017

(54) HEAT EXCHANGER FOR GASES, IN PARTICULAR FOR THE EXHAUST GASES OF AN ENGINE

(71) Applicant: Valeo Termico, S.A., Zaragoza (ES)

(72) Inventors: Juan Carlos De Francisco Moreno, Zaragoza (ES); Carlos Rodrigo Marco, Zaragoza (ES); Yolanda Bravo Rodriguez, Zaragoza (ES); Fernando Puertolas Sanchez, Zaragoza (ES)

(73) Assignee: VALEO TERMICO, S.A., Zaragoza (ES)

( * ) Notice: Subject to any disclaimer, the term of this patent is extended or adjusted under 35 U.S.C. 154(b) by 372 days.

(21) Appl. No.: 14/367,440

(22) PCT Filed: Dec. 18, 2012

(86) PCT No.: PCT/EP2012/076039
§ 371 (c)(1),
(2) Date: Oct. 9, 2014

(87) PCT Pub. No.: WO2013/092641
PCT Pub. Date: Jun. 27, 2013

(65) Prior Publication Data

US 2015/0027673 A1 Jan. 29, 2015

(30) Foreign Application Priority Data

Dec. 22, 2011 (ES) ..... 201132072

(51) Int. Cl.
*F28D 7/16* (2006.01)
*F28F 9/02* (2006.01)
(Continued)

(52) U.S. Cl.
CPC ..... *F28D 7/1607* (2013.01); *F02M 26/32* (2016.02); *F28D 7/1684* (2013.01);
(Continued)

(58) Field of Classification Search
CPC ..... F28D 7/1607; F28D 21/0003; F28D 2020/0089; F28D 9/005; F02M 26/32;
(Continued)

(56) References Cited

U.S. PATENT DOCUMENTS 7,380,544 B2 * 6/2008 Raduenz ..... F28D 9/0056 123/568.12
7,984,753 B2 * 7/2011 Ohfune ..... F28D 7/1684 165/157
(Continued)

FOREIGN PATENT DOCUMENTS

DE 102005037156 2/2007
DE 102005037156 A1 2/2007
(Continued)

OTHER PUBLICATIONS

English translation of Denso Corp. (JP2010-0286472).*
(Continued)

*Primary Examiner* — Dominick L Plakkoottam
*Assistant Examiner* — Joel Attey
(74) *Attorney, Agent, or Firm* — Howard & Howard Attorneys PLLC

(57) ABSTRACT

A heat exchanger (1) for gases, in particular for the exhaust gases of an engine includes a bundle of tubes (2) arranged inside a casing (3) defining a gas inlet (4) and outlet (5). The tubes (2) being intended for the circulation of the gases with a view to exchanging heat with a coolant, and the tubes (2) being distributed in at least one column having a plurality of rows defining a plurality of spaces (8) between the rows, and including a coolant inlet pipe (9) and outlet pipe (10) connected to the casing (3). The exchanger (1) includes a bypass channel (11) incorporated into the casing (3) capable of connecting the spaces (8) defined between the rows of tubes (2) located in front of the channel (11) with one of the
(Continued)

coolant pipes (10), in such a way as to improve the distribution of the coolant.

11 Claims, 6 Drawing Sheets

(51) Int. Cl.

| | |
|---|---|
| ***F28D 21/00*** | (2006.01) |
| ***F28F 9/00*** | (2006.01) |
| ***F02M 26/32*** | (2016.01) |
| *F28F 9/007* | (2006.01) |
| *F28D 9/00* | (2006.01) |
| *F28F 3/08* | (2006.01) |

(52) U.S. Cl.
CPC ..... *F28D 21/0003* (2013.01); *F28F 9/001* (2013.01); *F28F 9/026* (2013.01); *F28D 9/005* (2013.01); *F28F 3/08* (2013.01); *F28F 9/007* (2013.01); *F28F 9/0075* (2013.01); *F28F 9/0221* (2013.01); *F28F 2250/06* (2013.01); *F28F 2280/06* (2013.01)

(58) Field of Classification Search
CPC ..... F28F 9/001; F28F 9/026; F28F 2250/06; F28F 3/08; F28F 9/007; F28F 9/0075; F28F 9/0221; F28F 2280/06
USPC ..... 165/159
See application file for complete search history.

(56) References Cited

U.S. PATENT DOCUMENTS

2006/0201661 A1* 9/2006 Sugihara ..... F28D 7/1607 165/158
2008/0087409 A1* 4/2008 Nakamura ..... F28D 9/0025 165/165
2011/0247318 A1* 10/2011 Kuroyanagi ..... F02M 25/0737 60/278

FOREIGN PATENT DOCUMENTS

| | | | | |
|---|---|---|---|---|
| EP | 1647697 | A1 | 4/2006 | |
| EP | 1795850 | A1 | 6/2007 | |
| JP | 2008231929 | | 10/2008 | |
| JP | 2008231929 | A | 10/2008 | |
| JP | 2008232451 | | 10/2008 | |
| JP | 2008232451 | A | 10/2008 | |
| JP | 2009114923 | | 5/2009 | |
| JP | 2009114923 | A | 5/2009 | |
| JP | 20100286472 | * | 12/2010 | ..... F02B 29/0443 |

OTHER PUBLICATIONS

English language abstract and machine-assisted English translation for DE 102005037156 extracted from espacenet.com database on Aug. 8, 2014, 10 pages.
English language abstract and machine-assisted English translation for JP 2008231929 extracted from espacenet.com database on Aug. 8, 2014, 10 pages.
English language abstract and machine-assisted English translation for JP 2008232451 extracted from espacenet.com database on Aug. 8, 2014, 11 pages.
English language abstract and machine-assisted English translation for JP 2009114923 extracted from espacenet.com database on Aug. 8, 2014, 13 pages.
International Search Report for PCT/EP2012/076039 dated Apr. 9, 2013, 7 pages.

* cited by examiner

HEAT EXCHANGER FOR GASES, IN PARTICULAR FOR THE EXHAUST GASES OF AN ENGINE

RELATED APPLICATIONS

This application claims priority to and all the advantages of International Patent Application No. PCT/EP2012/076039, filed on Dec. 18, 2012, which claims priority to Spanish Patent Application No. ES 201132072, filed on Dec. 22, 2011, the content of which is incorporated herein by reference.

The present invention relates to a heat exchanger for gases, in particular for the exhaust gases of an engine.

The invention relates in particular to exchangers for recirculating the exhaust gases of an engine (EGRC).

BACKGROUND OF THE INVENTION

The main function of EGR exchangers is to exchange heat between the exhaust gases and the coolant for the purpose of cooling gases.

Currently, EGR heat exchangers are used extensively in diesel applications to reduce emissions and also in petrol applications to reduce the consumption of fuel.

The current market trend is to reduce the size of engines and install EGR heat exchangers, not only in high pressure (HP) applications but also in low pressure (LP) applications. However, these two types of application have an impact on the design of EGR heat exchangers. Vehicle manufacturers are demanding EGR heat exchangers with improved outputs but at the same time the space available for installing an exchanger and its components is becoming smaller and increasingly difficult to incorporate.

Furthermore, in many applications the flow of coolant for cooling exhaust gases has a tendency to decrease despite the increase in output of the exchanger.

The current design of EGR exchangers on the market corresponds to a metal heat exchanger, generally made from stainless steel or aluminium.

There are basically two types of EGR heat exchangers: a first type consisting of a casing containing a bundle of parallel tubes for the passage of gases, the coolant circulating in the casing around the tubes; and the second type comprising a series of parallel plates which form the heat exchange surfaces, such that the exhaust gases and the coolant circulate between two plates in alternate layers and it can comprise fins to improve the exchange of heat.

In the case of heat exchangers comprising a bundle of tubes the junction between the tubes and the casing can differ. Generally, the tubes are fixed at their ends between two support plates connected to each end of the casing, the two support plates having a plurality of openings for the insertion of the respective tubes.

Said support plates are fixed in turn to means for connecting to the recirculation line which can consist of a V-shaped connector or even a peripheral connecting rim or flange, depending on the design of the recirculation line where the exchanger is assembled. The peripheral rim can either be mounted with a gas reservoir, so that the gas reservoir is an intermediate part between the casing and the rim, or can be mounted directly onto the casing.

In both types of EGR exchanger most of the components are made of metal and are therefore assembled by mechanical means, then oven soldered or arc welded to guarantee the required degree of sealing for this application.

A known type of exchanger comprises a bundle of tubes with a basically rectangular cross section distributed over two adjacent columns and a plurality of rows, the height of the tubes being less than their width. Said bundle of tubes is housed in a basically rectangular casing, with the gas inlet and gas outlet located at opposite ends of the casing.

This type of exchanger also comprises two pipes connected to the casing, for the inlet and outlet of coolant respectively. The coolant has to circulate around the tubes and in particular cool the support plate located at the gas inlet effectively because of the raised temperature of said plate. In this case, it is necessary to ensure good circulation of the coolant in the gas inlet area to avoid the formation of low flow areas which would imply a local increase in the temperature of the coolant by exchange with the inlet gases at high temperatures.

The distribution of coolant in the casing between the gas tubes depends on the dimensions of the casing and the position of the coolant pipes. In specific configurations there is a problem that boiling may occur which is associated with a poor distribution of coolant close to the support plate of the gas inlet. Thus, the more effective the distribution of coolant in the area adjacent to the support plate of the gas inlet the easier it is to control the problem of boiling caused by the raised temperature of the tubes in said area.

In a known configuration the coolant inlet pipe is connected to aside of the casing, close to the underside and the gas outlet, whereas the coolant outlet pipe is connected to the topside of the casing, in the centre and close to the gas inlet. This configuration thus enables a counter-current circulation of the coolant. In this case the coolant outlet pipe is located above the space which separates the two columns of tubes, said space between the tubes being relatively small which makes the outflow of the coolant more difficult.

It should be noted that when the exchanger is used with parallel circulation, i.e. when the coolant inlet pipe is arranged close to the gas inlet, said boiling problems also occur.

In another known configuration with counter-current circulation, the coolant inlet pipe is connected beneath the casing, close to the gas outlet, whereas the coolant outlet pipe is connected to a side of the casing close to the gas inlet. In this case, the coolant outlet pipe takes up several spaces between the rows of tubes, as the height of the tubes is less than their width. The surface passed over by the coolant is thus greater between the tubes towards the outlet.

Consequently, in this last configuration the problem of boiling is improved, on the one hand because the flow of coolant is greater in the outlet area and on the other hand because its distribution between the tubes is more uniform. However, this configuration is not achievable in some arrangements and sizes of the engine space where the orientation of the connecting sleeve to the coolant outlet pipe is not satisfactory.

DESCRIPTION OF THE INVENTION

The object of the heat exchanger for gases, in particular for the exhaust gases of an engine, of the present invention is to overcome the disadvantages of the known exchangers of the prior art, in order to obtain a more homogenous and effective distribution of the coolant, in particular in the gas inlet area where the temperature is higher, with a resulting reduction of the problem of boiling, and also to enable a better adjustment between the connecting sleeve of the vehicle manufacturer and the coolant outlet or inlet pipe.

The heat exchanger for gases, in particular for the exhaust gases for an engine, of the present invention, is of the type comprising a bundle of tubes arranged inside a casing defining a gas inlet and a gas outlet, said tubes being intended for the circulation of the gases with a view to exchanging heat with a coolant and said tubes being distributed in at least one column having a plurality of rows defining a plurality of spaces between the rows and comprising a coolant inlet pipe and outlet pipe connected to the casing, said exchanger of the present invention being characterised in that it comprises a bypass channel incorporated into the casing capable of connecting the spaces defined between the rows of tubes located facing said channel with one of the coolant pipes, in such a way as to improve the distribution of the coolant.

Preferably, the height of the tubes is less than their width, and one of said coolant pipes is located facing the widest side of the tubes.

In an advantageous manner one of said coolant pipes is arranged close the gas inlet, thus improving the distribution of coolant in the area located close to the gas inlet.

In this way the bypass channel makes it possible to obtain a coolant outlet or inlet respectively, depending on whether the circulation is counter-current or parallel, on a side of the casing where the outlet flow crosses the space defined between the rows of tubes, and not the space facing the widest side of the tubes as is the case in the prior art.

Thus the coolant pipe located close to the gas inlet can be arranged on any side of the casing, regardless of where the sleeve of vehicle manufacturer is located for the connection of said coolant pipe.

As a result a channel is obtained for the passage of coolant, the trajectory of which can be adapted to the needs and the configuration of the engine space.

Furthermore, said coolant pipe arranged close to the gas inlet can be mounted on the casing and at one end of the channel in the usual manner.

Preferably, the bypass channel is manufactured using a stamping process and its configuration is such that it projects towards the outer portion of the casing.

In an advantageous manner, the bypass channel is associated with a closing plate connected to the casing in the inner space located facing said channel, said closing plate comprising at least one through opening provided to enable the controlled passage of coolant between the inside of the casing and the bypass channel.

Consequently, the coolant circulates in the channel through one or more openings formed in the closing plate, the number or size of which can be adjusted to obtain an optimal distribution of the coolant according to the requirements of the vehicle manufacturer.

According to a preferred embodiment the inner closing plate comprises two lateral openings.

According to another preferred embodiment, the inner closing plate comprises a set of lateral openings each associated with a space positioned every two rows of tubes and at least one upper opening located facing the coolant outlet pipe.

Furthermore, the bypass channel can have various configurations according to the flow of coolant and the characteristics of the engine environment.

According to a preferred embodiment, the bypass channel comprises a lateral opening provided for the connection of a second coolant outlet pipe.

In another preferred embodiment two bypass channels are arranged respectively on opposite sides of the casing.

In another preferred embodiment the bypass channel has a variable cross section over its entire length.

BRIEF DESCRIPTION OF THE DRAWINGS

In order to clarify the above description drawings are appended which illustrate, in schematic form and purely by way of non-limiting example, practical embodiments of the heat exchanger for gases, in particular for the exhaust gases of an engine of the present invention. In said drawings.

DESCRIPTION OF PREFERRED EMBODIMENTS

Figure 1:
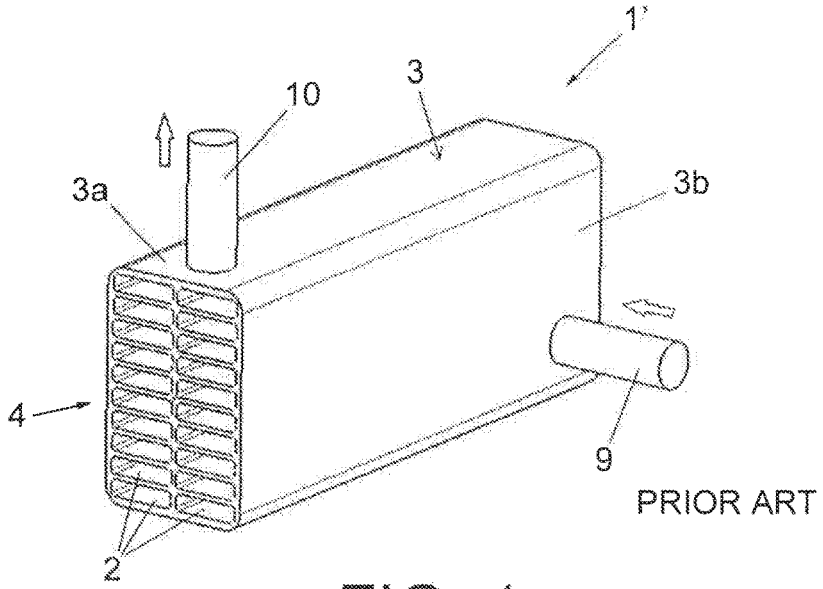
FIG. 1 is a perspective view of a heat exchanger known from the prior art which illustrates a possible configuration of inlet and outlet coolant pipes.

FIGS. 1 to 4 illustrate a type of heat exchanger 1' known from the prior art which comprises a bundle of tubes 2 arranged inside a casing 3 defining a gas inlet 4 and a gas outlet 5, said tubes 2 being designed for the circulation of gases for the purpose of exchanging heat with a coolant. Furthermore, the tubes 2 are fixed at their ends between two support plates 6, 6' connected to each end of the casing 3.

In this case the tubes 2 have a substantially rectangular cross section and are distributed over two adjacent columns and a plurality of rows. Said tubes 2 thus define a space 7 between the columns and a plurality of spaces 8 between the rows, the height of said tubes 2 being less than their width. The casing 3 has a quadrangular cross section.

Figure 2:
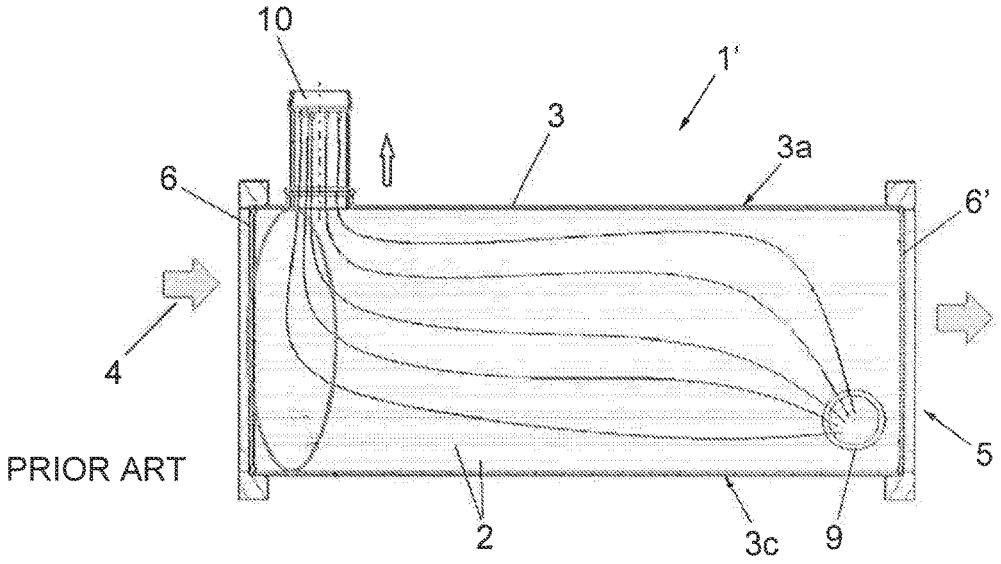
FIG. 2 is a longitudinal section of the heat exchanger of FIG. 1, which illustrates schematically the distribution lines of the coolant.

The exchanger 1' also comprises a coolant inlet pipe 9 and a coolant outlet pipe 10 connected to the casing 3. The input flow and output flow of coolant is indicated by respective arrows, as shown in FIGS. 1 and 2. In this case the circulation of coolant flows in a counter-current. The coolant inlet pipe 9 is connected to one side 3*b* of the casing 3, close to the underside 3*c* and the gas outlet 5, whereas the coolant outlet pipe 10 is connected to the topside 3*a* of the casing 3, in the centre and close to the gas inlet 4.

Figure 3:
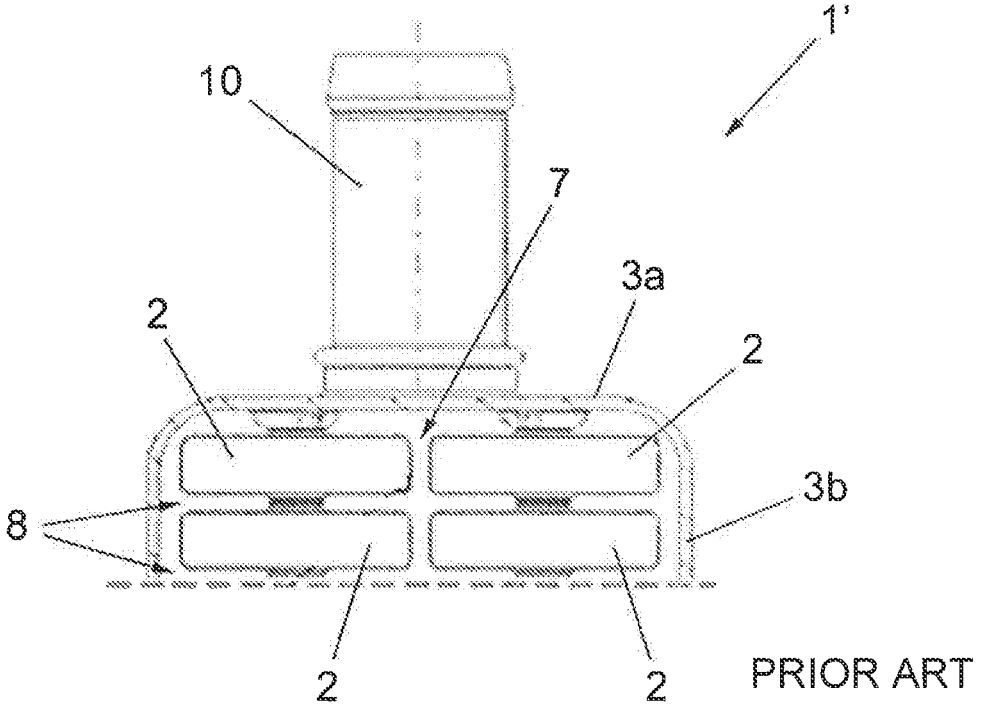
FIG. 3 is partial front view of the exchanger of FIG. 1, which illustrates the coolant outlet pipe and its position relative to the gas tubes.
Figure 4:
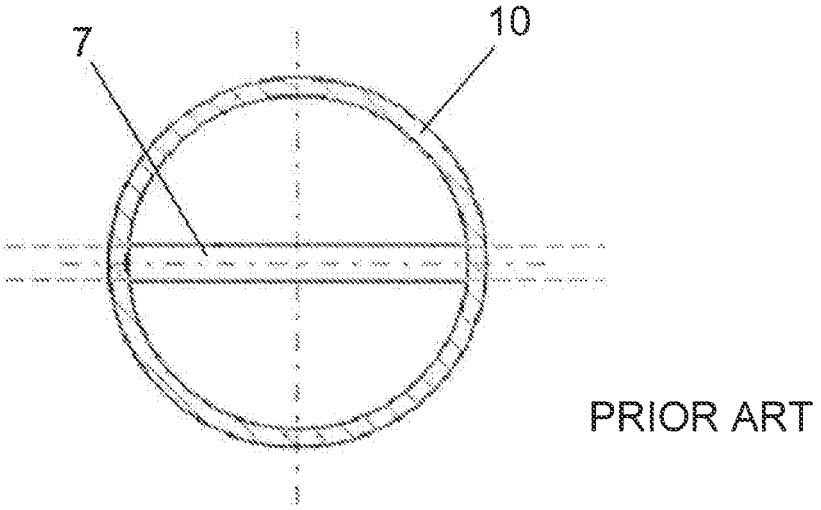
FIG. 4 is a schematic view of a cross section of the coolant outlet pipe of the exchanger of FIG. 1, which indicates its position above the space between two columns of tubes.

As shown in FIGS. 3 and 4, the coolant outlet pipe 10 is located above the space 7 which separates the two columns of tubes 2. However, said space 7 between two tubes 2 is relatively small, which makes the outflow of the coolant difficult. In this case, as shown by the curved lines in FIG. 2, it is necessary to direct the coolant towards the gas inlet area 4 with a strong flow, as the temperature of the gases is raised. The better the distribution of coolant in said area 4 adjacent to the support plate 6 of the gas inlet the easier it is to control the problem of boiling caused by the raised temperature of the tubes 2 in said area 4.

FIGS. 5 to 13 relate to the heat exchanger 1 of the invention, in which the reference numerals 2 to 10 coincide with those of the known exchanger 1' described above.

As shown in FIGS. 5 to 8, the heat exchanger 1 of the invention also comprises a bypass channel 11 incorporated into one side 3*b* of the casing 3 close to the gas inlet 4, said bypass channel 11 being capable of connecting the lateral space 8 defined between the rows of tubes 2 located facing said channel 11 with the coolant outlet pipe 10 arranged on top-side 3*a* of the casing 3. This structural arrangement improves in particular the distribution of coolant in the area close to the gas inlet 4.

The bypass channel 11 makes it possible to obtain a coolant outlet in one side 3*b* of the casing 3, where said output flow crosses spaces 8 defined between the rows of tubes 2, and not the space 7 defined between the columns as in the prior art, and regardless of where the sleeve of the vehicle manufacturer is located for connecting said coolant outlet pipe 10.

In this way a channel 11 is obtained for the passage of coolant, the trajectory of which can be adapted to the needs and the configuration of the engine space.

Figure 5:
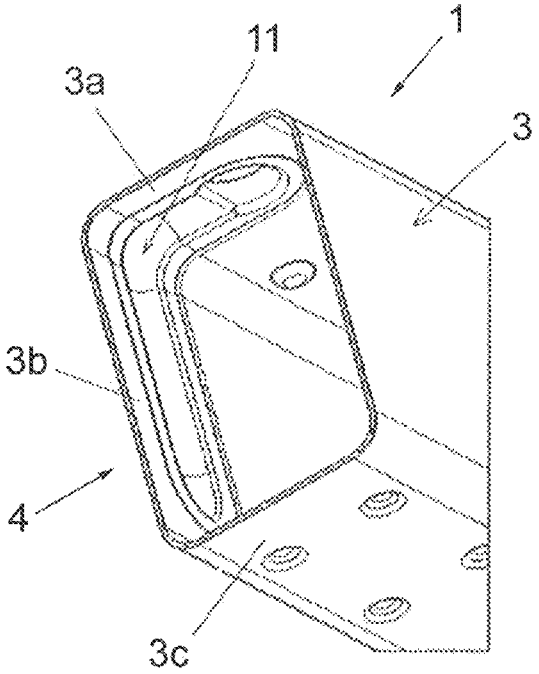
FIG. 5 is a partial perspective view of the heat exchanger according to the invention, which illustrates the channel stamped into a lateral wall of the casing.
Figure 8:
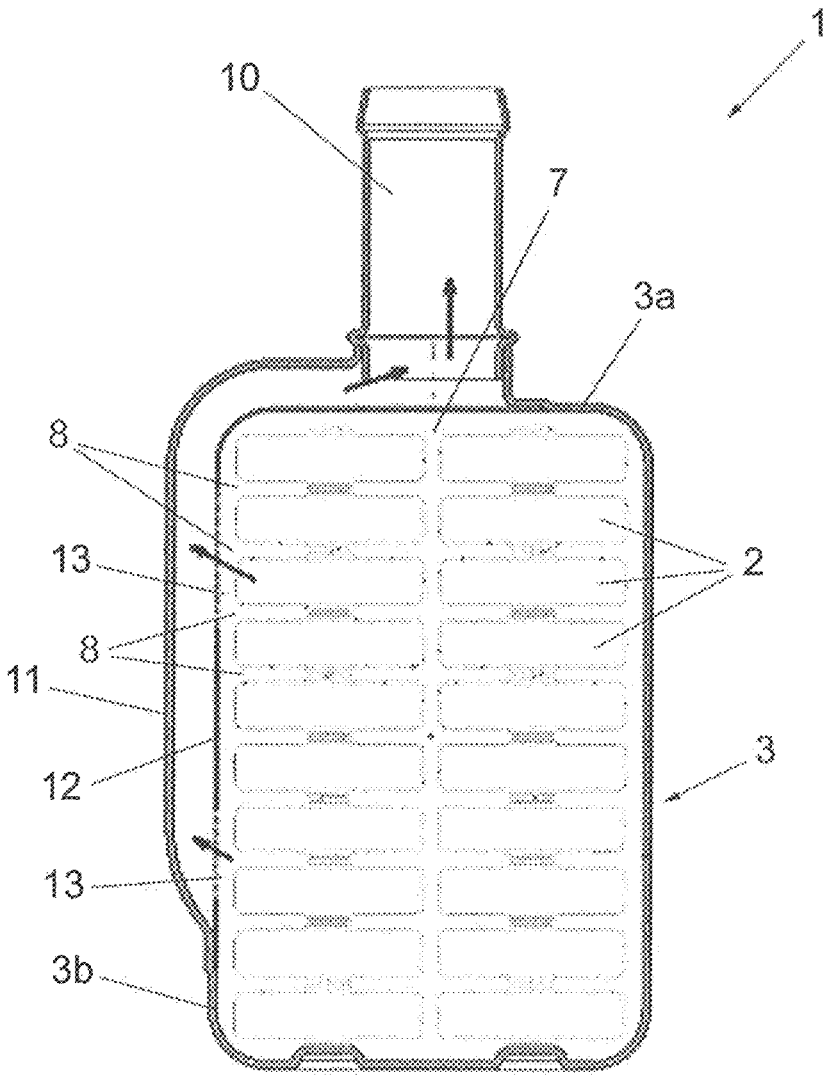
FIG. 8 is a cross section of the exchanger of the invention of FIG. 7 which illustrates the distribution of coolant through the closing plate and the channel towards the corresponding outlet pipe.

In this case the bypass channel 11 is produced by a stamping process and is designed to project towards the outer part of the casing 3, as shown in FIGS. 5 and 8.

Furthermore, the coolant outlet pipe 10 is mounted on the casing 3 and on one end of the channel 11 in the usual manner (see FIG. 8).

Similarly, the bypass channel 11 is associated with a closing plate 12 connected to the casing 3 in the inner space located facing said channel 11, said closing plate 12 comprising at least one through opening 13 provided to allow the controlled passage of coolant from inside the casing 3 to the bypass channel 11.

As a result the coolant enters into the channel 11 through one or more openings 13 formed in the closing plate 12, the number or the size of which can be modified in order to obtain an optimum distribution of coolant according to the requirements of the vehicle manufacturer.

Figure 6:
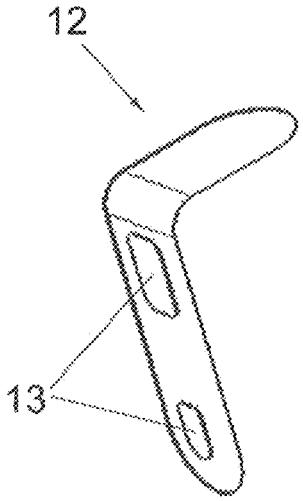
FIG. 6 is a perspective view of the inner closing plate of the invention, according to a first embodiment.
Figure 7:
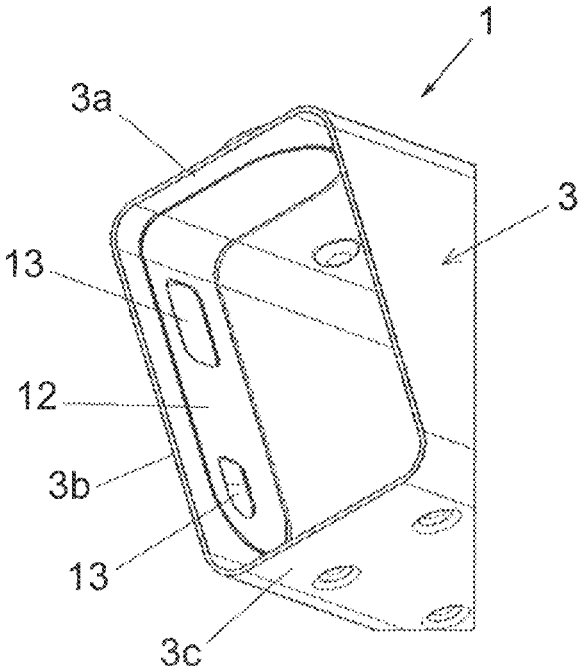
FIG. 7 is a partial perspective view of the heat exchanger according to the invention, with the inner closing plate mounted on the stamped channel.

According to a first embodiment of the closing plate 12 shown in FIGS. 6 to 8, said closing plate 12 comprises two lateral through openings 13. FIG. 8 illustrates by means of two arrows the outflow of the coolant through openings 13 towards the bypass channel 11, then towards the outlet pipe 10 respectively.

Figure 9:
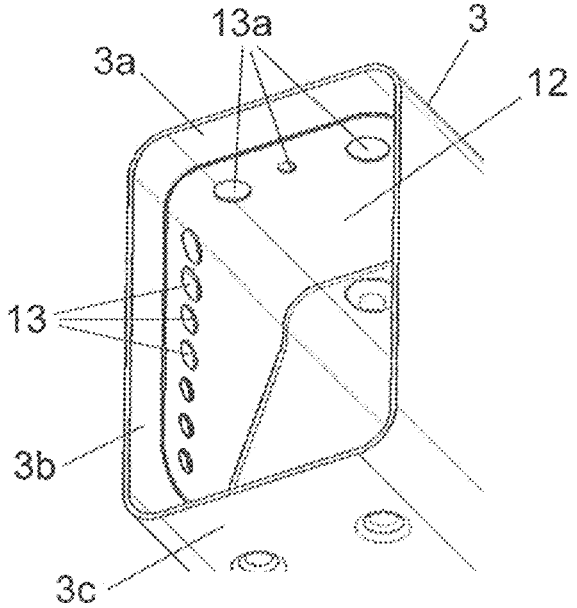
FIG. 9 is a partial perspective view of the heat exchanger according to the invention which illustrates a second embodiment of the inner closing plate.
Figure 10:
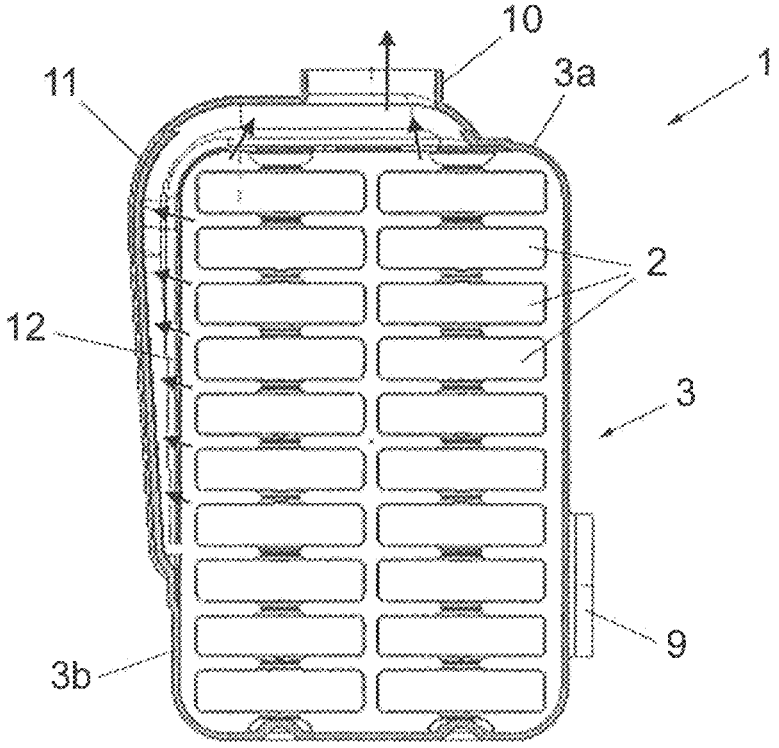
FIG. 10 is a cross section of the exchanger of the invention of FIG. 9 which illustrates the distribution of coolant through the closing plate and the channel towards the corresponding outlet pipe.

According to a second embodiment of the closing plate 12 illustrated in FIGS. 9 and 10, said closing plate 12 comprises a set of lateral openings 13 of small diameter each associated with a space 8 positioned every two rows of tubes 2, and a plurality of upper openings 13*a* located facing the coolant outlet pipe 10. Similarly in FIG. 10 the coolant outlet is shown by two arrows through the openings 13, 13*a* towards the bypass channel 11, then towards the outlet pipe 10 respectively.

It should be noted that up to now the heat exchanger has been described with a counter-current circulation of the coolant, but clearly the circulation can also be parallel, that is with the coolant inlet on the side close to the gas inlet.

Furthermore, although a bundle of tubes has been shown with two columns and a plurality of rows, other embodiments are also possible, for example having a single column and a plurality of rows.

Likewise, other kinds of geometries can be used for the bypass channel 11, according to the flow of coolant and the characteristics of the engine environment. Three embodiments are described below.

Figure 11:
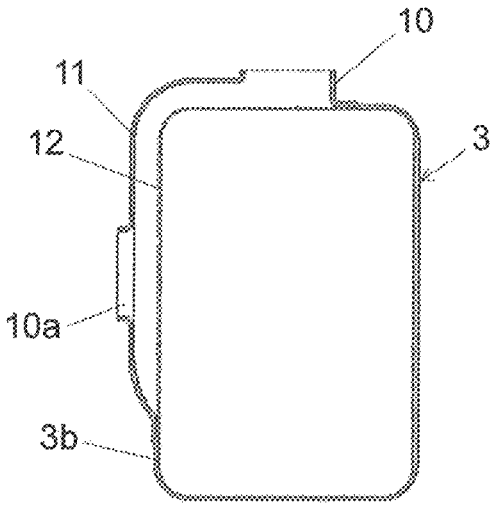
FIGS. 11 to 13 are cross-sectional views of the heat exchanger of the invention which illustrate respectively embodiments of the bypass channel.

According to a first embodiment shown in FIG. 11, the bypass channel 11 comprises a side opening for the connection of a second coolant outlet pipe 10*a*.

Figure 12:
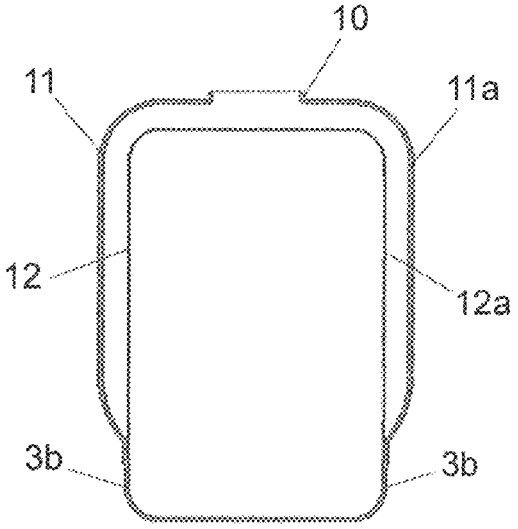

According to a second embodiment shown in FIG. 12 two bypass channels 11, 11*a* are used with their respective closing plate 12, 12*a*, arranged respectively on opposite sides 3*b* of the casing 3.

Figure 13:
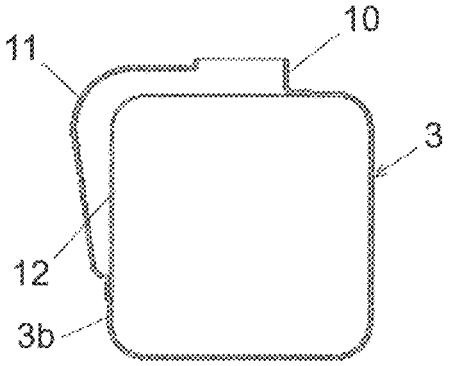

According to a third embodiment shown in FIG. 13 the bypass channel 11 has a variable cross section over its entire length.

The invention claimed is:

1. A heat exchanger (1) for gases, the heat exchanger (1) comprising a bundle of tubes (2) arranged inside a casing (3) defining a gas inlet (4) and a gas outlet (5), the tubes (2) being configured for the circulation of the gases with a view to exchanging heat with a coolant, and the tubes (2) being distributed in at least one column having a plurality of rows defining a plurality of spaces (8) between the rows, and comprising a coolant inlet pipe (9) and coolant outlet pipe (10) connected to the casing (3), and a bypass channel (11) incorporated into the casing (3) and connecting the spaces (8) defined between the rows of tubes (2) located facing the bypass channel (11) with the coolant outlet pipe (10) to improve the distribution of the coolant, wherein the bypass channel (11) is associated with a closing plate (12) coupled to the casing (3) in the inner space located facing the channel (11), the closing plate (12) comprising at least one lateral through opening (13) provided to allow controlled passage of coolant between an inside of the casing (3) and the bypass channel (11); and wherein said closing plate (12) is a single piece closing plate (12) and has a first portion disposed perpendicular to a length of said tubes and a second portion disposed parallel to the length of said tubes.

2. A heat exchanger (1) according to claim 1, wherein a height of the tubes (2) is less than a width of the tubes (2), and wherein the coolant outlet pipe (10) is positioned facing a widest side of the tubes (2).

3. A heat exchanger (1) according to claim 1, wherein the bypass channel (11) is manufactured using a stamping process, and the bypass channel (11) is configured to project towards an outer portion of the casing (3).

4. A heat exchanger (1) according to claim 1, wherein the closing plate (12) comprises two lateral through openings (13).

5. A heat exchanger (1) according to claim 1, wherein the closing plate (12) comprises a set of lateral openings (13) each associated with a space (8) positioned every two rows of tubes (2) for allowing passage of coolant, and at least one upper opening (13*a*) located facing the coolant outlet pipe (10) positioned adjacent to the gas inlet (4) for allowing passage of coolant.

6. A heat exchanger (1) according to claim 1, wherein the bypass channel (11) comprises a lateral opening provided for connecting a second coolant outlet pipe (10*a*).

7. A heat exchanger (1) according to claim 1, which comprises two bypass channels (11, 11*a*) arranged respectively on opposite sides (3*b*) of the casing (3).

8. A heat exchanger (1) according to claim 1, wherein the bypass channel (11) has a variable cross section over its entire length.

9. A heat exchanger (1) according to claim 1, wherein said closing plate (12) including said at least one lateral through opening (13) and said bypass channel (11) are arranged such that output flow of coolant is configured to cross said plurality of spaces (8).

10. A heat exchanger (1) according to claim 9, wherein said closing plate (12) including said at least one lateral through opening (13) and said bypass channel (11) are arranged such that output flow of coolant is configured to not cross a space (7) defined between said columns.

11. A heat exchanger (1) according to claim 1, wherein said closing plate (12) has an "L" shape.

* * * * *